US005259456A

United States Patent [19]

Edwards et al.

[11] Patent Number: 5,259,456

[45] Date of Patent: Nov. 9, 1993

[54] DRILL STEM TEST TOOLS

[75] Inventors: Jeffrey C. Edwards; Ray Johns, both of Aberdeen; Robert D. Buchanan, Belhelvie, all of Scotland

[73] Assignee: Exploration and Production Services (North Sea) Ltd., Reading, England

[21] Appl. No.: 768,516

[22] PCT Filed: Mar. 27, 1990

[86] PCT No.: PCT/GB90/00455

§ 371 Date: Sep. 26, 1991

§ 102(e) Date: Sep. 26, 1991

[87] PCT Pub. No.: WO90/11429

PCT Pub. Date: Oct. 4, 1990

[30] Foreign Application Priority Data

Mar. 29, 1989 [GB] United Kingdom ..... 8907098

[51] Int. Cl.[5] ..... E21B 34/10

[52] U.S. Cl. ..... 166/319; 166/324

[58] Field of Search ..... 166/373, 319, 324, 332, 166/250

[56] References Cited

U.S. PATENT DOCUMENTS

| | | | |
|---|---|---|---|
| 3,976,136 | 8/1976 | Farley et al. | 166/319 X |
| 4,429,748 | 2/1984 | Beck | 166/324 |
| 4,448,254 | 5/1984 | Barrington | 166/373 |
| 4,655,288 | 4/1987 | Burris, II et al. | 166/319 |
| 4,736,798 | 4/1988 | Zunkel | 166/324 X |
| 5,101,904 | 4/1992 | Gilbert | 166/319 |

*Primary Examiner*—William P. Neuder

*Attorney, Agent, or Firm*—Brady, O'Boyle & Gates

[57] ABSTRACT

Once a new oil well has been drilled and cased, a test string is set in place for the purpose of evaluating the production potential of the chosen formation. One way of controlling the operation of the various tools included in the downhole test string, including the opening and closing of the downhole valve itself, is by changes in the pressure differential between the tubing and the annular space which surrounds it in the well, but this requires the provision and maintenance of a fixed "reference" pressure within the tool, and a convenient such pressure is the hydrostatic (annulus) pressure experienced by the string after it has been lowered down the well bore and set into the packer.

The invention proposes that reference pressure within the test string be trapped by a novel mechanism wherein a valve (4) drivable into a closed position by a first piston (3) open (at 5) to annulus pressure first defines, and then defines and closes, the open-to-tubing-pressure entrance (6) to a passageway (30/19) leading to a reference-gas-containing chamber (22) via a second piston (20) therewithin. The invention also proposes a new mechanism by which compensation can be made for the effect of downhole temperature changes on the gas in a reference pressure chamber, in which mechanism there is a hydraulic-liquid-containing chamber (27) which is connected at one end, via a piston (25) thereat, to a vent (24) to annulus and at the other end to two "one-way" passageways (28, 29) linking it to the reference-gas-containing chamber (22) via a chamber-contained second piston (23).

17 Claims, 4 Drawing Sheets

DRILL STEM TEST TOOLS

BACKGROUND OF THE INVENTION

1. Field of the Invention

This invention relates to tools used in the testing of subterranean wells, and concerns in particular the mechanism by which such tools—especially but not exclusively those for use in hydrocarbon-bearing wells—are operated.

2. Description of The Prior Art

Whether at sea or on land, the first stages in the production of a new hydrocarbon well—an oil well—are the drilling of the well bore itself through the various formations within the earth's crust beneath the drilling rig, followed by "casing" (the introduction and cementing into position of piping which will serve to support and line the bore) and the introduction into the bore, at the depth of a formation of interest, of a device known as a packer, into which inner tubing (of smaller diameter than the casing) can subsequently be lodged.

The next work carried out is normally some programme of testing, for the purpose of evaluating the production potential of the chosen formation. The testing procedure usually involves the measurement of downhole temperatures and pressures, in both static and flow conditions (the latter being when fluid from the relevant formation is allowed to flow into and up the well), and the subsequent calculation of various well parameters. To collect the necessary data there is used a test string—a length of tubing containing the tools required for the testing—that is lowered into the well bore to the required (test) depth. Either the packer has previously been placed at that depth, and the test string is then set into the packer, or the packer is sent down as part of the test string, and then set into place in the bore; in any event, once the string is set in the packer and the packer is set in the bore, the tubing of the string is isolated from the surrounding well.

One essential component of the test string is a valve known as the downhole valve, which is used to control the flow of fluid out of the formation and into and up the well tubing. The density of drilling fluid in the tubing above this valve is adjusted such that its hydrostatic pressure at the depth of the formation is lower than the formation fluid pressure. Thus, when the valve is opened, formation fluid is permitted to enter the well bore through perforations in the casing and flow into the tubing string (and possibly to the surface therethrough). This contrasts with the situation during drilling, when the drilling mud must exert a hydrostatic pressure greater than the formation fluid pressure in order to prevent the formation fluid's escape to the surface.

The operation of the various tools included in the downhole test string, including the opening and closing of the downhole valve itself—and, consequently, the control of the testing procedure—can be effected using one of three main types of mechanism. These types are those actuated by reciprocal motion of the pipe string (the inner tube, of which the test string constitutes a part), by rotational motion of the pipe string, or by changes in the pressure differential between the tubing and the annular space which surrounds it in the well—hereinafter referred to simply as "the annulus". Test strings wherein the tools thereof are activated by changes in annulus pressure are at present much in vogue, and it is this type of mechanism with which the invention is particularly concerned.

A mechanism of the annulus pressure-responsive type requires the provision and maintenance of a fixed "reference" pressure within the tool. This, used in conjunction with an adjustable (and higher) annulus pressure, allows the establishment of the chosen pressure differential necessary to control the operation of the appropriate component of the test string.

To ensure that the downhole tools operate within a narrow known band of applied annulus pressure, it is essential that a constant reference pressure be established within the tool string. A convenient such pressure to trap is the hydrostatic ambient (annulus) pressure experienced by the string after it has been lowered down the well bore and set into the packer. This annulus pressure may, through a suitable connection, be communicated to a gas-filled pressure chamber within the string. However, once trapped the reference pressure must be isolated from both the annulus and the tubing so that fluctuations in the pressures therein will not affect the reference pressure. Allowance must also be made for the commonly-encountered situation wherein there is a pressure increase within the tubing, during stabbing into the packer, due to a "pistoning" effect (the annulus liquid being displaced by the descending tubing can no longer escape up past the tubing once the latter has reached, and is being stabbed into, the packer, so there is a pressure build-up)—this excess pressure must be dissipated, and not communicated to the reference pressure chamber.

Variations in environmental temperature tend, via thermal expansion and contraction of the pressurised gas, to alter the reference pressure, and so it is unfortunately also preferable to provide some means of compensating for this. Finally, additional temperature compensation may be required if, as is quite common, certain procedures known in the Art as stimulation, which attempt to improve the oil yield of the formation, are employed once the initial well testing is completed Two examples of such procedures are hydraulic fracturing and acid stimulation. Their details are not relevant here, except inasmuch as they may require the pumping to the formation, via the test string, of fluids that are cold relative to the formation temperature—acids, for example. A pumping operation of this kind will cause the reference pressure to drop, due to contraction of the gas as it cools, unless some provision is made to maintain it—and, furthermore, the pressure will rise again once the pumping has ceased unless once more it is adjusted. Analogous problems can similarly occur during the pumping (albeit rare) of hot fluids to the formation—for example, to help remove waxy deposits blocking the perforations in the casing.

All these situations, then, require some suitable means first of isolating and then of maintaining the reference pressure in order that it should remain constant (normally at the true hydrostatic pressure) under any foreseeable conditions, thus allowing a known pressure differential to be created between the tool and the annulus simply by raising the annulus pressure to a predetermined level.

It is these means that the invention seeks to provide. Firstly, the invention proposes that reference pressure within the test string be trapped by a novel mechanism wherein a valve drivable into a closed position by a first piston open to annulus pressure first defines, and then defines and closes, the open-to-tubing-pressure entrance to a passageway leading to a reference-gas-containing chamber via a second piston therewithin. Using this mechanism, firstly, as the open-ended test string is lowered into the wall bore, tubing pressure is in equilibrium with annulus pressure, and is communicated via the passageway entrance and the chamber-contained piston to the reference gas, and secondly, after the test string has been stabbed into the packer, so isolating tubing pressure from annulus pressure, a momentary increase in annulus pressure will cause the first piston to move to drive the valve into the passageway-closed position, thus effectively sealing off the trapped reference gas from any further pressure changes.

Secondly, the invention proposes a new mechanism by which compensation can be made for the effect of downhole temperature changes on the gas in a reference pressure chamber, in which mechanism there is a hydraulic-liquid-containing chamber which is connected at one end, via a piston thereat, to a vent to annulus and at the other end to two "one-way" passageways linking it to the reference-gas-containing chamber via a chamber-contained second piston. With this mechanism, upon cooling (and thus contraction and pressure reduction) of the reference gas the resultant excess annulus liquid pressure is communicated to, and exerted on, the second piston via the first piston and the hydraulic liquid, thus causing a movement of the second piston which will re-compress the gas and restore reference pressure. Similarly, upon heating (and expansion and pressure increase) of the reference gas, the resultant excess gas pressure is communicated to, and exerted upon, the first piston via the second piston and the hydraulic liquid, thus causing a movement of the first piston to vent chamber-contained annulus fluid, and thereby allowing movement of the second piston which will decompress the gas and restore reference pressure.

BRIEF SUMMARY OF THE INVENTION

In one aspect, therefore, this invention provides a reference pressure tool containing therewithin a chamber holding a reference pressure gas and having means for trapping ambient pressure therein, which trapping means comprises:

a valve drivable into a closed position by a first piston open to annulus pressure; and a passageway defined by the valve body, and closed by the valve when the latter is in its closed position, which passageway has an entrance open to tubing pressure and leads to the reference-gas-containing chamber via a chamber-contained second piston;

whereby tubing pressure is communicated to the reference gas, via the passageway entrance and the chamber-contained piston, until an applied increase in annulus pressure over tubing pressure causes the first piston to move to drive the valve into the passageway-closed position, thus effectively sealing off the trapped reference gas from any further pressure changes.

DETAILED SUMMARY OF THE INVENTION

In a second aspect, therefore, this invention provides a reference pressure tool containing therewithin a chamber holding a reference pressure gas and having means for compensating for the effect of temperature changes on the gas, which compensation means comprises:

a hydraulic-liquid-containing chamber connected at one end, via a piston thereat, to a vent to annulus;

two passageways, each containing a one-way valve acting in the opposite direction to that in the other, which passageways link the other end of the hydraulic-liquid-containing chamber to the reference-gas-containing chamber via a chamber-contained second piston;

whereby, upon thermally-induced pressure reduction of the reference gas the resultant excess annulus liquid pressure is communicated via the first piston and the hydraulic liquid to the second piston, which then moves to re-compress the gas, whilst upon thermally-induced pressure increase of the reference gas the resultant excess gas pressure is communicated via the second piston and the hydraulic liquid to the first piston such that the second piston moves initially to decompress the gas while the first piston moves to vent chamber-contained annulus liquid.

In its first aspect the invention provides a reference pressure tool incorporating means for trapping ambient tubing pressure within a reference gas chamber therein. Although notionally the chamber might be of any shape, configuration and size, it is most conveniently an annular chamber constructed within the walls of the test tubing. These walls are about 1 cm (0.5 in) thick; it is relatively easy to provide therewithin an annular chamber having a "cross sectional" thickness of around 1 cm (0.5 in). As to the size (volume) of the chamber, this naturally depends on the number of tools that the test string incorporates and that are operated by pressurised liquid derived ultimately from the gas in the chamber. In general, however, it will be desirable to have at least 13 liters (800 $in^3$) of pressurised reference gas.

The reference pressure gas itself may be any gas that is both capable of remaining gaseous under the downhole ambient conditions and non-toxic and non-corrosive. That gas commonly used is nitrogen. While this gas may be introduced into the pressure chamber at normal pressures (that is to say, at 1 atmosphere), it is in fact much preferred to pump the gas in at a higher pressure—in the neighbourhood of 135 Bar (2000 psi)—which ensures that the relevant floating piston(s) will have sufficient freedom of movement at the test string's planned operating depth.

The reference pressure tool of the invention allows ambient tubing pressure at the operating depth to be trapped and utilised thereafter as a reference pressure against which annulus pressure can be used to provide an excess pressure to operate the various tools in the test string. The trapping means comprises a piston-driven valve defining (and closing) a passageway open to tubing pressure and leading via another piston to the gas chamber.

In much the same way that the gas chamber can be of any form but is preferably annular, being constructed within the tube walls, so the other major components of the trapping means are similarly preferably annular, fitting within or adjacent the tube walls. Thus, the valve is most conveniently a sleeve valve, internally mounted of the tubing and sliding along the tube from an initial open position to a final closed position, and comprising a tubular valve body bearing a valve member which is itself a ring seal that is moved along to and into contact with an internal tubing wall (defining the passageway, as discussed below). The first piston (which is conveniently a "floating" piston without a con-rod connecting it to any other part of the tool) is also most conveniently annular. Moreover, although it would be possible to use a piston conventionally mounted between the oppssing side walls of a chamber, it is in fact preferred to employ a step-form sleeve piston—that is to say, a piston in the form of a sliding sleeve halfway along the sliding face of which is a step effectively constituting the driven face thereof (against which pressure is applied to drive the piston), both the thicker and thinner sleeve portions above and below the step having ring seals that seal the piston to the surface against which it slides. Such a stepped sliding-sleeve piston is shown in the accompanying Drawings, and described hereinafter.

The piston can drive the valve in any convenient way. Advantageously, however, in effect it merely abuts one end of the valve body, and in operation simply pushes the valve body from its "open" to its "closed" position.

The valve body, together with an internal surface of the tube, defines part—an annular part—of an internal passageway the rest of which may be a narrow "pipe" formed within the tube walls. Along this passageway in operation can flow annulus fluid contained within the tube—unless, of course the valve has moved to its "closed" position, in which case the passageway is sealed shut by the valve member itself. This passageway is open at one end to the inside of the tube, and thus to tubing pressure, and the necessary opening is conveniently at the "annular" portion end—and, indeed, by way of an aperture in and through the valve body. At the other end (the "pipe" end) the passageway opens into the reference pressure gas chamber, but a direct connection between the passageway and the gas in the chamber is prevented by a piston—in the preferred case, a floating annular piston—operatively mounted within the gas chamber at or adjacent the passageway's opening thereto.

In a preferred embodiment of the invention there is within the passageway a non-return valve preventing the flow of passageway-contained tubing liquid back towards (and possibly out of) the end of the passageway open to tubing pressure. This prevents loss of reference pressure immediately after stabbing-in should the formation pressure be less than annulus pressure (as may sometimes be the case). The non-return valve may take any convenient form, but preferably it is annular, mounted within an annular valve chamber forming a widened part of the annular portion of the passageway to the gas chamber, and spring-loaded into a position where it closes off the egress of the upstream section of the passageway into the valve chamber.

In operation, the open-ended test string containing the reference pressure tool is lowered slowly into the well bore, and as this occurs tubing pressure is communicated to the reference gas via the passageway entrance and the chamber-contained piston, whereupon drilling liquid (tubing and annulus) pressure will act both upon the first, valve-driving piston and upon the second, gas-chamber-contained piston (in the latter case, via the passageway opening from the tubing). However, the tool is not affected in any way until it has been lowered beyond the depth at which the downhole hydrostatic pressure exerted by the drilling liquid exceeds the pressure of the pre-pressurized reference gas within the chamber. Upon passing this depth, the excess liquid pressure subsequently exerted on the reference gas via the chamber-contained piston progressively compresses the reference gas so that the pressure thereof is always equal to the ambient hydrostatic pressure. This compression process continues until the required test depth is reached, whereupon the test string is "stabbed in" to the packer—that is to say, it is sealingly lodged therein—thus isolating, for the first time, the tubing of the tool from the annulus.

Following stabbing-in, the required reference pressure contained within the gas chamber must be trapped by driving the valve into its closed position. This is achieved by momentarily increasing annulus pressure over tubing pressure. This new increased pressure—applied to the annulus from the head of the well in any convenient way—creates a pressure differential across the valve-driving piston, which now experiences hydrostatic (tubing) pressure on one side and the applied (and higher) annulus pressure on the other. The piston therefore moves, and as it does so drives the valve into its closed position, thus sealing the passageway leading to the reference gas chamber, and so effectively isolating the gas therein from any further pressure changes.

As the test string is slowly lowered down the well bore as just described the pressures of the drilling liquid within tubing and annulus are continuously equalised by the unrestricted flow of that liquid around the test string. It will, however, be appreciated that during stabbing-in there is no longer any chance for a flow of displaced drilling liquid up past the tube to equalise these pressures completely. There results a "piston effect", which causes tubing pressure to increase over annulus pressure; if uncompensated, this will result in the subsequently-trapped reference pressure being too high, due to capture of the (excess) tubing pressure instead of the desired hydrostatic pressure. Accordingly, in a preferred form the reference pressure tool of the invention incorporates a mechanism by which the excess tubing pressure generated on stabbing-in can be bled off to annulus without being communicated to the reference gas chamber. That mechanism conveniently employs a one-way bleed valve opening to annulus and positioned along the passageway to the reference gas chamber, which bleed valve opens whenever tubing pressure markedly exceeds annulus pressure by some pre-set value. In a tool which incorporates such a mechanism in addition to the preferred non-return valve described hereinbefore, the relative positioning of the two valves along the passageway may be such that the bleed valve is either upstream or downstream of the non-return valve, though having regard to the limited space available the valve is very preferably an annular valve (like the non-return valve) situated upstream. Thus the bleed valve is preferably co-axial with the non-return valve's chamber, and operatively connected between the latter chamber and a port to annulus, spring-loaded into a position where it blocks the egress of the connection to the latter chamber, and so prevents ingress of liquid thereinto.

In its second aspect the invention also provides a reference pressure tool incorporating a gas-filled reference pressure chamber. The remarks contained hereinbefore regarding the nature of both chamber and gas in the first tool are equally applicable in this case, and accordingly no further comment will be made here—save, perhaps, to point out that the second tool may naturally be one of the first tool's type as described herein.

This second reference pressure tool includes means for compensating for the effect of temperature changes on the gas—specifically, means utilising a chamber of hydraulic liquid connected at one end (via a piston thereat) to a port to annulus, and at the other to another piston in the reference gas chamber via two "one-way"

passageways. The liquid chamber is conveniently annular, and constructed within the tube walls in much the same way as the reference gas chamber. Its dimensions, and hence the volume of fluid contained therewithin, depend at least in part on the magnitude of the temperature range that is anticipated. Generally, however, a volume of 13 liters (800 $in^3$) will be sufficient.

The hydraulic liquid requires no special properties save those of remaining liquid in all foreseeable circumstances, and of being generally inert— non-toxic, non-corrosive, and, especially, non-explosive. Suitable liquids are silicone oils, as is well known in the Art.

The piston separating the liquid chamber from the port to annulus is, in a preferred embodiment of the invention, another annular, floating piston.

The liquid chamber is linked at its other end (the end not connected to the port to annulus) to two passageways leading to a piston within the reference gas chamber. In a reference pressure tool incorporating both the reference pressure trapping means of the invention and the temperature compensation means presently being described, it may be appreciated that the gas chamber will thus be bounded by two pistons (conveniently both of the floating annular kind), one of which is adjacent the open-to-tubing passageway required for the trapping of reference pressure, and the other of which links (indirectly) the gas chamber to the hydraulic liquid chamber.

The passageways linking the gas- and hydraulic-liquid-chambers are conveniently housed within the tube walls, and of narrow tubular form. Each passageway has within its length a one-way valve, very preferably of a pressure-sensitive variety. Not only does this valve permit only unidirectional flow therethrough (and the arrangement is such that one passageway allows flow only in one direction whilst the other allows flow only in the other direction), but in addition the flow is restricted to an extremely low rate (about 1 cc per 10 minutes) regardless of the pressure drop across the valve (the reason for this is discussed hereinafter in more detail with reference to the Drawings, but briefly it is to prevent sudden annulus pressure changes which affect the pressure of the hydraulic liquid from further affecting the pressure of the gas in the reference pressure chamber connected thereto). Thus, provided the pressure differential is low enough, in one passageway hydraulic liquid may flow from the chamber up to the piston only, whilst in the other the reverse is true. Valves of this one-way, restrictor nature are well known, and commercially available.

In operation, as the test string is lowered into the well bore the hydrostatic pressure will at some point exceed the pressure of the chamber-contained hydraulic liquid. When this happens, drilling liquid from the annulus will enter the port, and will cause the piston contained within the hydraulic liquid chamber to "move" to pressurize the liquid, thus continuously adjusting the pressure thereof to the hydrostatic pressure. The same pressure will also be communicated to the liquid contained within the passageway permitting flow to the gas chamber (the liquid in the other passageway will remain at its initial value, since the required direction of flow to increase it is prevented by the one-way valve).

Following stabbing-in and the trapping of the reference pressure, any reduction in the ambient temperature—such as might occur during a stimulation with cold acid—will in the first instance cause the pressure of the gas within the reference pressure chamber to drop (initially the volume of the gas notionally stays the same—it is that volume contained within the piston-bounded chamber). If the reference pressure were to remain at this reduced level problems would arise in operating the test string because the application to the annulus liquid of a pressure a specific amount higher than the expected reference pressure (in order to create the pressure differential by which one of the tools is activated) would no longer necessarily have the desired effect when measured against the now reduced reference pressure. However, in the tool of the invention a (thermally-induced) pressure drop of this nature gives rise to a pressure differential across the gas-chamber-contained piston of the temperature compensation means. On one side, this piston experiences the reduced gas pressure, and on the other it experiences the unchanged (and therefore higher) hydrostatic—that is, annulus—pressure which is being communicated to it via the hydraulic-liquid-filled passageway and chamber and the open-to-annulus piston. The gas-chamber piston therefore moves under the influence of the excess liquid pressure in such a way that the volume of the reference gas chamber bounded thereby is decreased. The pressure of the gas within the chamber thus increases until it once more equals the original hydrostatic (reference) pressure. In this way the correct operation of the test string in response to applied annulus pressure is ensured even during a drop in ambient downhole temperature.

The described temperature reduction may eventually be reversed (as when, for example, acid stimulation ceases, and the ambient temperature increases to the normal, "background" level), and when this happens the resulting increase in reference gas pressure (as the gas heats up) must suitably be allowed for. In the mechanism of the invention there will now be a pressure differential across that piston between the gas chamber and the liquid chamber such that the higher pressure is that exerted by the reference gas. The piston thus moves to allow the gas to expand (thereby reducing its pressure). As it does so, the hydraulic liquid is pushed through the passageway and liquid chamber, and in turn drives the open-to-annulus piston to vent annulus liquid from the tool—a process that continues until reference pressure has been restored to the desired value.

Provided it is not too large, any temperature variation—and, indeed, any sequence of such variations—occurring down the well can be suitably compensated by adjustments of the types just described, thereby ensuring that the pressure differential required for test tool operation may always correctly be achieved by application of a previously-calculated annulus pressure.

The materials employed in the construction of the various components of the two inventions hereinbefore described may be any of those normally utilised in the Art for similar construction. Thus, for example, the tubing of the tool may be of a low carbon alloy steel, and the valve gear may be of any suitably non-corrodible substance (for example, INCONEL).

Although this invention has been described in the main with reference to oil wells, it can in fact be of use in any kind of well—oil, gas or water, for instance—where it is necessary or desirable to investigate the downhole formations.

BRIEF DESCRIPTION OF THE DRAWINGS

An embodiment of the invention is now described, though by way of illustration only, with reference to the accompanying diagrammatic drawings in which.

Figure 2A:
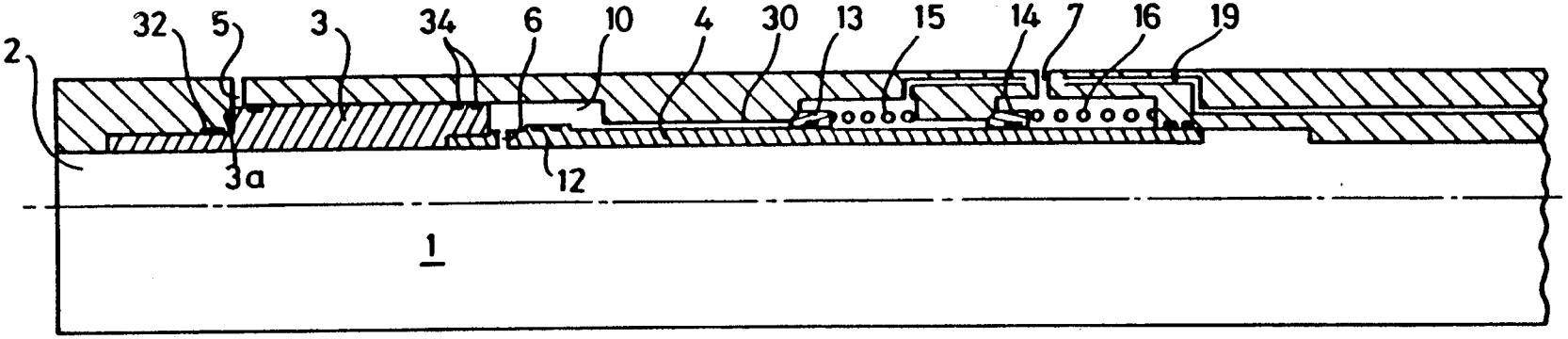
FIGS. 2A/B show a tool of the invention as it appears in cross-section prior to stabbing into the packer.
Figure 2B:
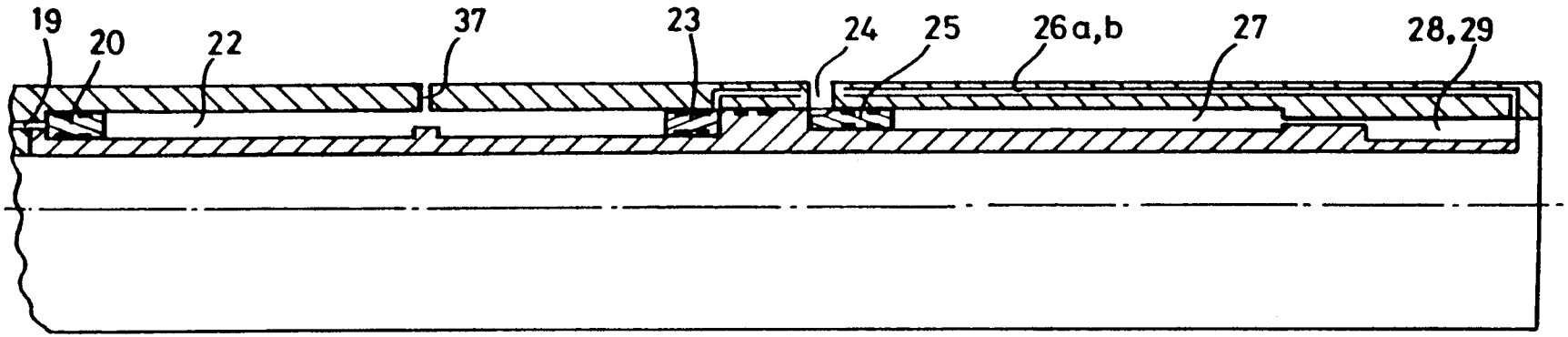
Figure 3A:
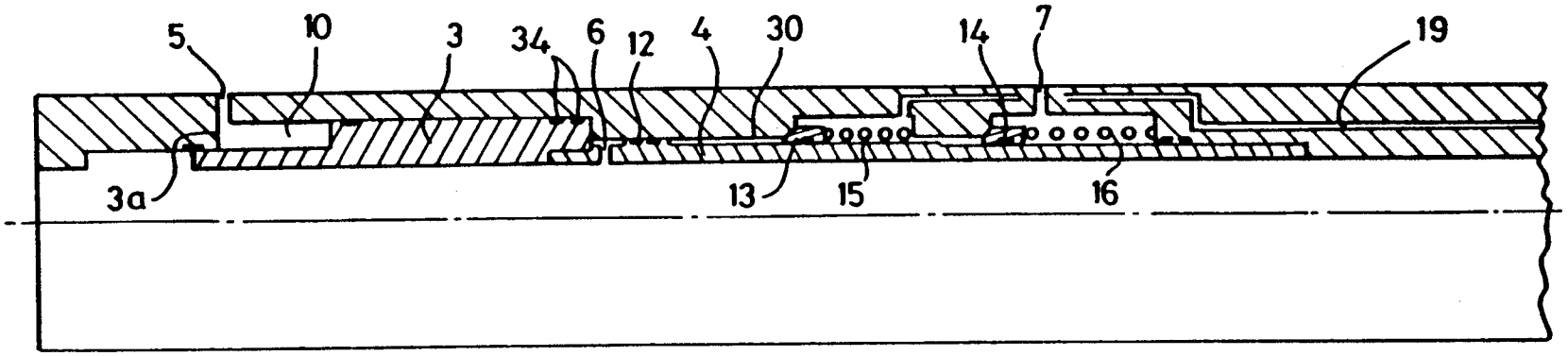
FIGS. 3A/B show the tool of FIG. 2 after stabbing into the packer and applying a high annulus pressure.
Figure 3B:
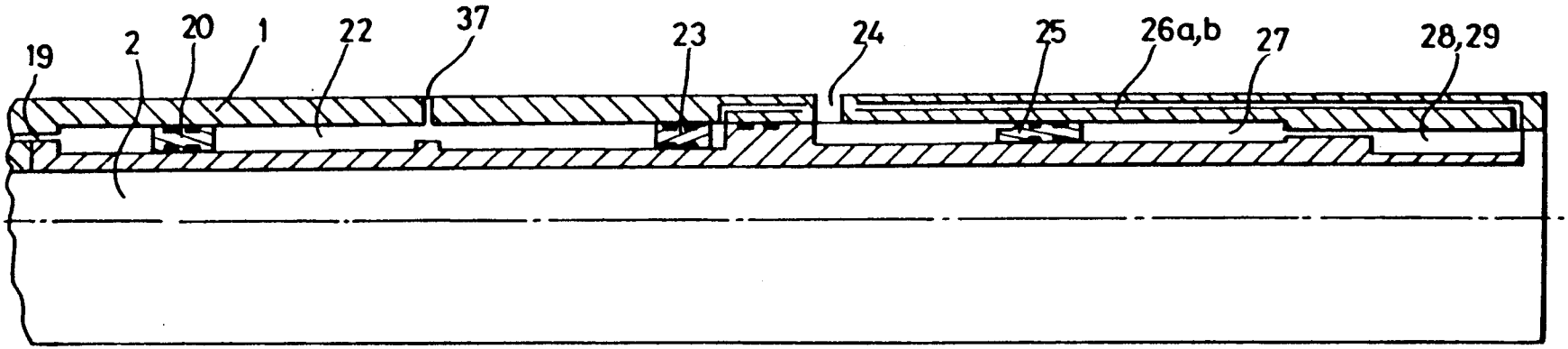

In each of FIGS. 2 and 3 the A and B sections are, in reality, connected—the left side of the B figure runs on from the right side of the A figure.

DESCRIPTION OF THE PREFERRED EMBODIMENT

Figure 1:
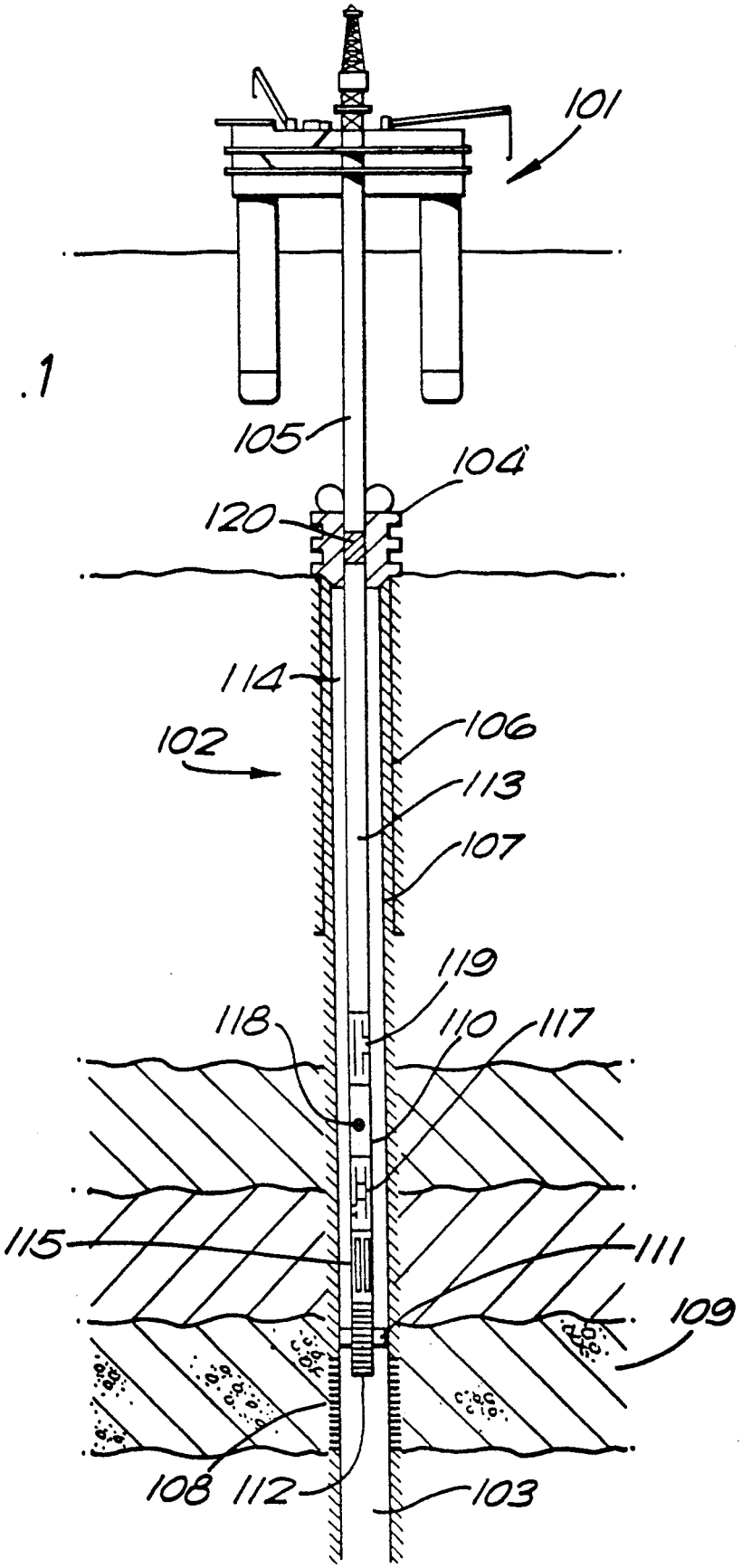
FIG. 1 is a simplified cross sectional view of an offshore oil well with a test string including a tool of the invention.

FIG. 1 shows a floating drilling rig (101, not shown in detail) from which has been drilled an oil well (generally 102) having a well bore (103) reaching down to a rock stratum constituting the formation (109) of interest. Located at the top of the well bore 103 is a blow-out preventer mechanism (BOP; 104, not shown in detail) which is connected to the rig 101 by a marine riser (105). Cemented into the well bore 103 are a shallow casing (106) and a deep casing (107); the lower end of the latter has a multitude of perforations (as 108) permitting communication between the well bore 103 and the oil formation 109.

Situated within the well bore 103 is a test string (110) comprising tubing (113) ending in a set of test tools (see below). The string 110 is set at its lower end into a packer (111), and a seal sleeve (112) seals the packer 111 to the test string 110, thus isolating the tubing 113 thereof from the annulus (114).

Above the seal sleeve 112 is a gauge carrier (115) which contains electronic or mechanical gauges (not shown) which collect downhole pressure and temperature data during the test sequence. Above the gauge carrier 115 are the constant pressure reference tool (117) and the downhole valve (118; the operation of which enables the test sequence to be carried out). A circulating sleeve (119) permits removal of any formation fluid remaining within the test string 110 prior to its withdrawal from the well bore 103. At the top of the test string is a subsea test tree (120) which serves both as a primary safety valve and as a support for the rest of the test string 110.

FIGS. 2 to 5 show a constant pressure reference tool 117 of the invention having a main housing (1) and the tubing internal bore (2). At the lower end (at the left as shown) of the tool there is within an annular chamber (10) a floating annular stepped sliding sleeve piston (3; shown hatched) which communicates with liquid (not shown) in the annulus (not shown specifically—it is the volume "outside" the housing 1) by way of a port (5) to annulus (the annulus liquid is applied to the face of a step halfway along the sleeve, and presses thereagainst so as in operation to drive the piston towards the right as shown). Communication between annulus and tubing 2 around piston 3 is prevented by elastomer seals (32, 34).

The floating piston 3 is in direct driving contact with a sliding (seal) sleeve valve (4; shown hatched) having elastomer seals (12) and which, when driven by the piston 3, is capable of movement (to the right as shown) along the annular chamber 10. A port (6) through the sleeve 4 permits communication between tubing 2 and annular chamber 10. Since, prior to stabbing in, the tubing 2 is open to annulus, the liquid pressures acting on each side of floating piston 3 through ports 5 and 6 are equal, and so no movement of piston 3 (or sleeve 4) occurs.

A narrow annular passageway (30) leads from the annular chamber 10 to a one-way spring-loaded valve (13) which permits liquid flow therethrough once the force of its valve spring (15) has been overcome, but which prevents the return of this liquid. Beyond valve 13 are another, pipe-like, passageway (19) and a further one-way spring-loaded valve (14) with an associated spring (16). The valve 14 will only allow liquid to pass through it if the pressure thereof markedly exceeds the pressure of the liquid in the annulus. Downstream of the valve 14 is a port (7) to annulus.

Passageway 19 leads to an annular, reference-gas-containing reference pressure chamber (22; the gas is usually nitrogen), confined at either end by a floating piston (20, 23). A port (37) permits direct communication between gas chamber 22 and outside the tubing and the gas may be charged into the chamber 22 therethrough (after which the port is sealed up). On the other side of the piston 23 there opens a pair of narrow passageways (**26*a* and 26*b*; not shown separately in the Drawings) which lead, via pressure-sensitive, one-way valves (28, 29 respectively; not shown in detail) to an annular chamber (27) containing hydraulic liquid. These two valves 28, 29 are pressure-sensitive in that they remain open while the pressure across them stays below a certain, predetermined, threshold value, but close immediately that threshold value is reached or exceeded. The reason for this is so that when, as is discussed hereinafter, there is a sudden and substantial rise (or fall) in annulus pressure, the relevant valve will close to prevent transfer of this pressure change on into the rest of the system, but that such a pressure transfer will be permitted if the change in annulus pressure is small or slow. The liquid chamber 27 is connected to a port (24) to annulus via a further floating piston (25). Valve 28 permits liquid flow along passageway 26*a* from chamber 27 towards piston 23 only, whereas valve 29 allows liquid flow away from piston 23** only.

Before the tool is lowered, as part of the test string, into the well bore, the gas within the reference pressure chamber 22 and the hydraulic liquid within chamber 27 are both adjusted to a pressure of 135 Bar (2000 psi). During the lowering process, liquid in the annulus and tubing 2 surrounds the tool, enters the ports 5, 6, 7 and 24, and fills annular chamber 10 and passageway 19 (the liquid does not, however, pass valve 14 since the liquid pressures either side thereof—in tubing 2 and the annulus via port 7—are equal).

The liquid does not at first enter the reference pressure chamber 22 or the hydraulic liquid chamber 27 because these have initial internal pressures greater than the hydrostatic pressure exerted by the well liquid. When the tool reaches a certain depth, however, hydrostatic pressure will exceed the pressure of the reference gas and of the hydraulic liquid. This hydrostatic pressure will act upon the gas, having been communicated through port 6 to chamber 10 and along passageway 19 to piston 20. This piston will thus move along chamber 22, to pressurize the gas therein until pressure balance is restored (when the gas reaches hydrostatic pressure). Similarly, well liquid entering port 24 will push piston 25 into the liquid chamber 27 until the pressures within the chamber and passageway **26*a* equal the instantaneous hydrostatic pressure (the pressure of the liquid within passageway 26***b* remains at its initial value due to the action of valve 29).

When, having reached the required test depth, the test string is stabbed into the packer, the pressure within the tubing 2 will tend to increase above the hydrostatic pressure as a result of a "pistoning" effect. When this happens, valve 14 opens and excess liquid from within the tool is vented to the annulus via port 7 until tubing and hydrostatic pressures are again equal. The pressure of the gas within annular chamber 22 thus remains at the hydrostatic pressure—and indeed non-return valve 13 ensures that it does remain so even if, because of a low formation pressure, tubing pressure should drop below annulus hydrostatic pressure.

After the test string has been stabbed into the packer, the tubing 2 and the annulus are isolated from each other. It is then necessary suitably to isolate the reference pressure trapped within chamber 22. To achieve this, the annulus pressure is briefly increased (by a suitable force applied at the surface). This increased annulus pressure is observed at ports 5, 7 and 24, but not at port 6 (which still experiences tubing—hydrostatic—pressure only), so now there is a pressure differential across floating piston 3. This differential forces the piston, together with seal sleeve 4, along annular chamber 10, bringing the sleeve into its "closed" position (as shown in FIG. 3), where port 6 is closed and the passageway 30 is sealed off by elastomer seal 12. The increased annulus pressure experienced at port 7 cannot influence pressure within the tool because of the presence of one-way valve 14. At port 24, however, the increased annulus pressure will cause movement of piston 25 such that the hydraulic liquid within chamber 27 is pressurized until it also attains this increased pressure. However, since the pressure increase in the annulus is effected suddenly, it produces a large pressure differential—greater than the pre-set value—across restrictor valve 28, which accordingly closes, and thus prevents the increased annulus pressure from being transmitted to the reference gas.

Once the applied annulus pressure has caused the required movement of piston 3 and sleeve valve 4, the excess pressure is bled off at surface so that annulus hydrostatic pressure is once more the true ambient pressure. This procedure is accompanied by the venting of tool-contained annulus liquid from port 24 by piston 25 until the hydraulic liquid within chamber 27 also returns to hydrostatic pressure.

Figure 4:
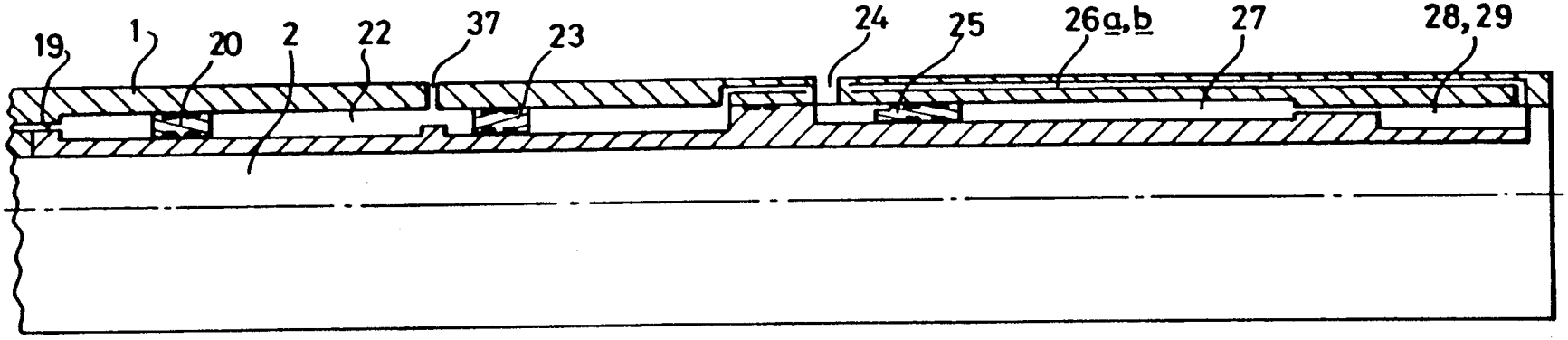
FIG. 4 shows the B section of the tool of FIG. 2 after a drop in ambient downhole temperature.
Figure 5:
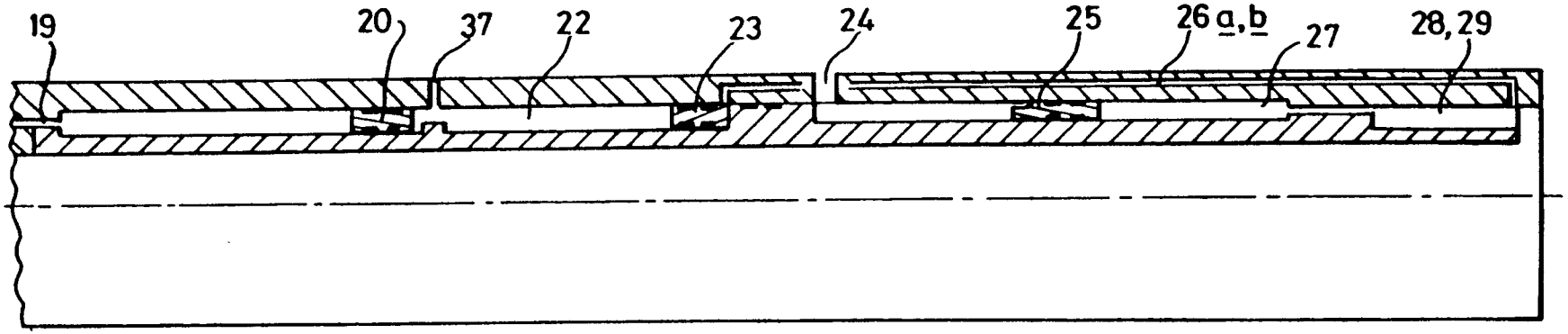
FIG. 5 shows the B section of the tool of FIG. 2 after an increase in ambient downhole temperature.

FIGS. 4 and 5 show the effect on the tool of changes in downhole temperature.

FIG. 4 shows the effect of a drop in downhole temperature. Any resultant (small) drop in the pressure of the hydraulic liquid within chamber 27 is rectified by movement of piston 25 initiated by the corresponding excess hydrostatic pressure exerted thereon by annulus liquid. The reference is, however, susceptible to a much more significant pressure drop. This results in pressure differentials arising across both of the gas-chamber-contained pistons 20 and 23 which drive these pistons towards each other, re-pressurizing the gas. Piston 20 will move only slightly (there is only a small volume of liquid behind it, and hence pressure balance thereacross is soon restored), but piston 23 will move as far as is necessary to re-establish the original reference pressure in the gas (the hydraulic liquid in passageway 26 and chamber 27 is always maintained at hydrostatic pressure by influx of annulus liquid at port 24 as just described).

The effect of a rise in the ambient downhole temperature is shown in FIGS. 4 and 5. The reference gas pressure (and, much less significantly, that of the hydraulic liquid) also rises. The hydraulic liquid pressure is maintained by flow of annulus liquid through port 24. In the case of the gas, pressure differentials are created across floating pistons 20 and 23 which would tend to drive these pistons away from each other, to allow the reference pressure to adjust to the desired hydrostatic pressure. However, when floating piston 23 reaches the upper end of the gas chamber 22 it is unable to move further to reduce the pressure differential across it. Restoration of the reference pressure to its original value must therefore be effected by movement of piston 20. As this happens, the well liquid contained in the chamber 22 on the other side of the piston 20, and in passageway 19, is pressurized. When its pressure exceeds hydrostatic pressure, valve 14 will open and vent excess liquid to the annulus via port 7 until equilibrium is reached.

We claim:

1. A reference pressure tool for use with a well test string in the form of one or more length of pipe tubing having walls defining an internal bore such that in operation the tubing is inserted into a borehole of a well to be tested, and is subject to tubing pressure within the tubing bore and to annulus pressure outside the tubing, the reference pressure tool comprising within its tubing a chamber holding a reference pressure gas and having trapping means for trapping ambient pressure therein, said trapping means including a first piston acted upon by annulus pressure, and a valve having a valve body moveable between a valve-open position and a valve-closed position, and drivable into the valve-closed position by said first piston;

said chamber also containing a second piston, and said trapping means also including a passageway defined by the valve body, said passageway being closed by the valve when the valve body is in its closed position, said passageway having within the valve body an entrance open to tubing pressure, and said passageway leading to said reference gas containing chamber via said chamber-contained second piston;

whereby tubing pressure is communicated to the reference gas, via said passageway entrance and the chamber-contained second piston, until an applied increase in annulus pressure over tubing pressure causes said first piston to move to drive said valve body into the passageway-closed position, thus effectively sealing off the trapped reference gas from any further pressure changes.

2. A tool as claimed in claim 1, wherein the chamber holding the reference pressure gas is an annular chamber constructed within the walls of the test string tubing.

3. A tool as claimed in claim 1, wherein, to drive the valve, the first piston merely abuts one end of the valve body, and in operation simply pushes the valve body from its open to its closed position.

4. A tool as claimed in claim 1, wherein there is within the passageway a non-return valve preventing the flow of passageway-contained tubing liquid back towards, and possibly out of, the end of the passageway open to tubing pressure.

5. A tool as claimed in claim 4, wherein the non-return valve is annular, mounted within an annular valve chamber forming a widened part of the annular portion of the passageway to the gas chamber, and spring-loaded into a position where it closes off the egress of the upstream section of the passageway into the valve chamber.

6. A tool as claimed in claim 1, wherein there is incorporated a mechanism by which the excess tubing pressure generated on stabbing-in can be bled off to annulus without being communicated to the reference gas chamber.

7. A tool as claimed in claim 6, wherein the bleed-off mechanism employs a one-way bleed valve opening to annulus and positioned along the passageway to the reference gas chamber, which bleed valve opens whenever the pressure-trapping valve is open and tubing pressure markedly exceeds annulus pressure by some pre-set value.

8. A tool as claimed in claim 7, wherein the bleed valve is annular and co-axial with the non-return valve's chamber, and operatively connected between the latter chamber and a port to annulus, spring-loaded into a position where it blocks the egress of the connection to the latter chamber, and so prevents ingress of liquid thereinto.

9. A well test string which incorporates a reference pressure tool as claimed in claim 1.

10. A tool as claimed in claim 1, wherein the valve body, together with an internal surface of the tube, defines an annular part of an internal passageway the rest of which is a narrow pipe formed within the tube walls, and wherein the passageway is open to the inside of the tube, at the annular portion end, by way of an aperture in and through the valve body, while at the other end, the pipe end, the passageway opens into the reference pressure gas chamber via a floating annular piston operatively mounted within the gas chamber at or adjacent the passageway's opening thereto.

11. A reference pressure tool for use with a well test string in the form of one or more length of pipe tubing having walls defining an internal bore such that in operation the tubing is inserted into a borehole of a well to be tested, and is subject to tubing pressure within the tubing bore and to annulus pressure outside the tubing, the reference pressure tool comprising, an annular chamber constructed within the walls of the test string tubing and holding a reference pressure gas and having trapping means for trapping ambient pressure therein, said trapping means including a first piston acted upon by annulus pressure, and a sleeve valve having a tubular valve body mounted internally of the tubing and slidably moveable along the tubing between an initial valve-open position and a final valve-closed position, and driveable into the valve-closed position by said first piston;

said chamber also containing a second piston, and said trapping means also including a passageway defined by the valve body, said passageway being closed by the sleeve valve when the valve body is in its closed position, said passageway having within the valve body an entrance open to tubing pressure, and said passageway leading to said reference gas containing chamber via said chamber-contained second piston;

said tubular valve body bearing a valve member which is itself a ring seal that is moved along to and into contact with an internal tubing wall defining the passageway;

whereby tubing pressure is communicated to the reference gas, via said passageway entrance and the chamber-contained second piston, until an applied increase in annulus pressure over tubing pressure causes said first piston to move to drive said valve body into the passageway-closed position, thus effectively sealing off the trapped reference gas from any further pressure changes.

12. A tool as claimed in claim 11, wherein the first piston is a floating piston, and is also annular, and is a step-form sleeve piston.

13. A reference pressure tool for use with a well test string in the form of one or more length of pipe tubing having walls defining an internal bore such that in operation the tubing is inserted into a borehole of a well to be tested, and is subject to tubing pressure within the tubing bore and to annulus pressure outside the tubing, the reference pressure tool containing within its tubing a chamber holding a reference pressure gas and having means for compensating for the effect of temperature changes on the gas, in which tool the compensation means comprises, a compensation chamber for containing a hydraulic liquid, said chamber having two ends and containing spaced therebetween two pistons, and having at one end a vent to annulus to which the chamber contents are connected via one of said two pistons; and two passageways, each containing a one-way valve acting in the opposite direction to that in the other, which passageways link the other end of said compensation chamber to the reference gas containing chamber via the other piston of said two pistons;

whereby, upon thermally-induced pressure reduction of the reference gas the resultant excess annulus liquid pressure is communicated via said one piston and the hydraulic liquid to said other piston, which then moves to re-compress the gas, whilst upon thermally-induced pressure increase of the reference gas the resultant excess gas pressure is communicated via said other piston and the hydraulic liquid to said one piston such that said other piston moves initially to decompress the gas while said one piston moves to vent chamber-contained annulus liquid.

14. A tool as claimed in claim 13, wherein the liquid chamber is annular, and constructed within the tube walls.

15. A tool as claimed in claim 13, wherein the piston separating the liquid chamber from the port to annulus is an annular, floating piston.

16. A tool as claimed in claim 13, wherein the passageways linking the gas- and hydraulic-liquid-chambers are housed within the tube walls, and of narrow tubular form, and each has within its length a pressure-sensitive one-way valve that restricts the flow therethrough to an extremely low rate regardless of the pressure drop across the valve.

17. A well test string which incorporates a reference pressure tool as claimed in claim 13.

* * * * *